US006524130B1

(12) United States Patent
Yeh

(10) Patent No.: US 6,524,130 B1
(45) Date of Patent: Feb. 25, 2003

(54) ELECTRICAL CONNECTOR ASSEMBLY

(75) Inventor: Joel Jyhhaur Yeh, Diamond Bar, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/161,957

(22) Filed: Jun. 3, 2002

(51) Int. Cl.[7] ..... H01R 13/60; H01R 13/66
(52) U.S. Cl. ..... 439/541.5; 439/108
(58) Field of Search ..... 439/541.5, 79, 439/108, 608

(56) References Cited

U.S. PATENT DOCUMENTS 5,709,554 A * 1/1998 Savage, Jr. ..... 439/541.5
6,099,351 A * 8/2000 Wu ..... 439/541.5
6,126,481 A * 10/2000 Wu et al. ..... 439/541.5
6,227,905 B1 * 5/2001 Tsai et al. ..... 439/541.5
6,234,833 B1 * 5/2001 Tsai et al. ..... 439/541.5
6,234,834 B1 5/2001 Tsai et al.
6,309,227 B1 * 10/2001 Chen et al. ..... 439/79

* cited by examiner

*Primary Examiner*—Lynn D. Feild
*Assistant Examiner*—Hae Moon Hyeon
(74) *Attorney, Agent, or Firm*—Wei Te Chung

(57) ABSTRACT

An electrical connector assembly comprises a first and a second housing members (21, 22) connected together, two sets of identical first terminals (31, 32) received in the first and second housing members, two sets of second terminals (41, 42) contacted with the sets of first terminals respectively, a grounding terminal (5) having a body strip (51) and a pair of arms (52), a spacer (6) assembled to the housing members. The spacer has a base portion (61) defining an two sets of retaining slots (612, 613), an elongated slit (614) in a rear face, and two pairs of insertion holes (615, 616) in communication with the two sets of retaining slots, respectively. Retaining portions (422) of the second terminals are retained in the retaining slots of the spacer and the body strip of the grounding terminal is retained in the elongated slit.

18 Claims, 9 Drawing Sheets

ELECTRICAL CONNECTOR ASSEMBLY

BACKGROUND OF THE INVENTION

1. Field of the Invention

The present invention relates to an electrical connector assembly, and particularly to an electrical connector assembly having a plurality of vertically stacked connectors.

2. Description of Related Art

With the trend toward miniaturization in computer technology, a variety of electrical connector assemblies have been developed. U.S. Pat. Nos. 5,709,554, 6,227,905, 6,234,833 and 6,234,834 disclose several related conventional electrical connector assemblies. The connector assemblies disclosed in these patents comprise two types of configuration. A first type is that the connectors of the assembly are vertically stacked, all terminals of the connectors extending downward to mount on a PCB with mating faces of the connectors perpendicular to the PCB. Referring to FIG. 3 of the '554 patent, an electrical connector assembly thereof comprises four different housings assembled in a vertically stacked manner. Four different molds are needed to manufacture the four different housings. This increases cost of the stacked connector assembly. Furthermore, when the stacked connector assembly is assembled on a printed circuit board (PCB), an area occupied by the stacked connector assembly is large, which is disadvantageous in view of the precious available area of the PCB. Referring to FIG. 9 of the present invention, which is a copy of FIG. 1 of the '834 patent, a stacked connector comprises first and second housing members 71, 72 having a same structure with each other. A spacer 8 defines a plurality of grooves 81 to receive and position two sets of contacts 9 therein. This connector assembly is assembled on a PCB (not shown) by tail portions 91 of the contacts 9 inserted into through holes of the PCB. A second type configuration is that the connectors of the assembly is arranged horizontally side by side. In some applications, it is required that a vertically stacked connector assembly is soldered to a printed circuit board by surface mounting technology (SMT). Both the above mentioned two types of stacked connector assembly can not meet such requirement.

SUMMARY OF THE INVENTION

It is an objective of the present invention to provide a vertically stacked connector assembly which is soldered to a PCB by SMT.

To achieve the above-mentioned object, an electrical connector assembly in accordance with the present invention comprises a dielectric housing group including first and second housing members connected together and each have a front face adapted for plugging in a corresponding one of mating connectors and a rear face, the rear face defines a plurality of receiving slots toward the front face. A plurality of first terminals assemble to a corresponding receiving slots and each of them comprises a contacting portion and a mating portion extending from the contacting portion. A plurality of second terminals each has a mating portion, a retaining portion extending from an end of the mating portion and a solder portion extending from an end of the retaining portion. A spacer has a base portion with a plurality of retaining slots and insertion holes defined in a rear surface of the base portion. The retaining slots are generally parallel to the rear face of the housings. The insertion holes run through the base portion and are in communication with the retaining slots of the spacer and the receiving slots of the housing. The retaining portions of the second terminals are received in the retaining slots of the spacer. The mating portions of the second terminals are inserted into the insertion holes and further received in the receiving slots of the housings and electrically connect with the mating portions of the first terminals. A grounding terminal has a body strip and a pair of arm sections extending from the body strip. Each arm section assembles to one of the receiving slot of each housing and the body strip is received in the retaining slot of the spacer. A solder portion extends from an end of the body strip. The solder portions of the grounding terminal and the second terminals extend beyond the spacer for being soldered on the PCB.

Other objects, advantages and novel features of the invention will become more apparent from the following detailed description of the present embodiment when taken in conjunction with the accompanying drawings.

DETAILED DESCRIPTION OF THE INVENTION

Figure 1:
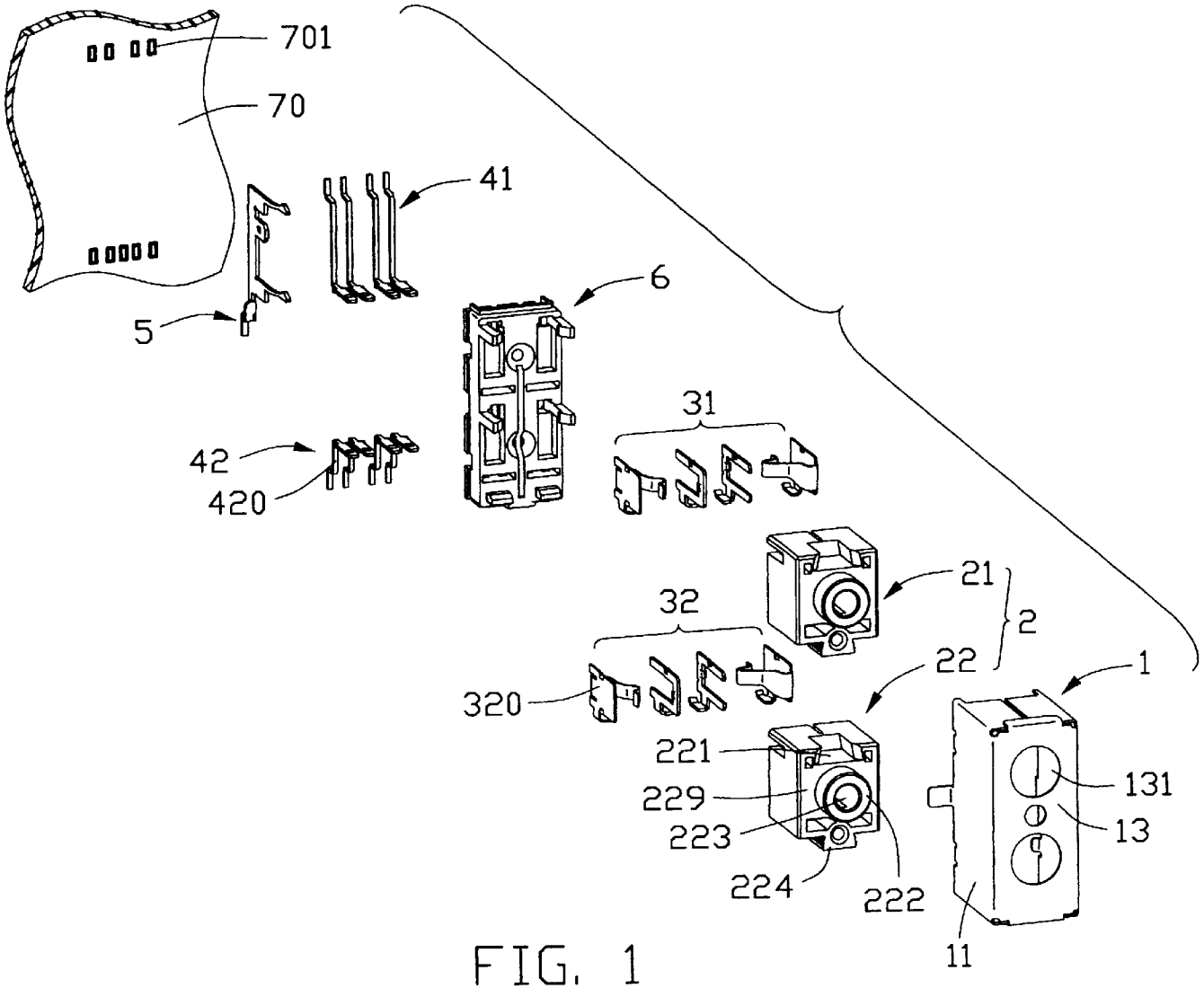
FIG. 1 is an exploded perspective view of an electrical connector assembly with a printed circuit board in accordance with the present invention.

Referring to FIG. 1, an electrical connector assembly in accordance with the present invention comprises a dielectric housing group 2 including first and second housing members 21, 22, two identical sets of first terminals 31 and 32 to be received in the first and second housing members 21, 22, respectively, two sets of second terminals 41, 42 to engage with the first terminals 31, 32 respectively, a one-piece grounding terminal 5, a spacer 6, and a shield 1 for enclosing the electrical connector assembly.

Figure 2:
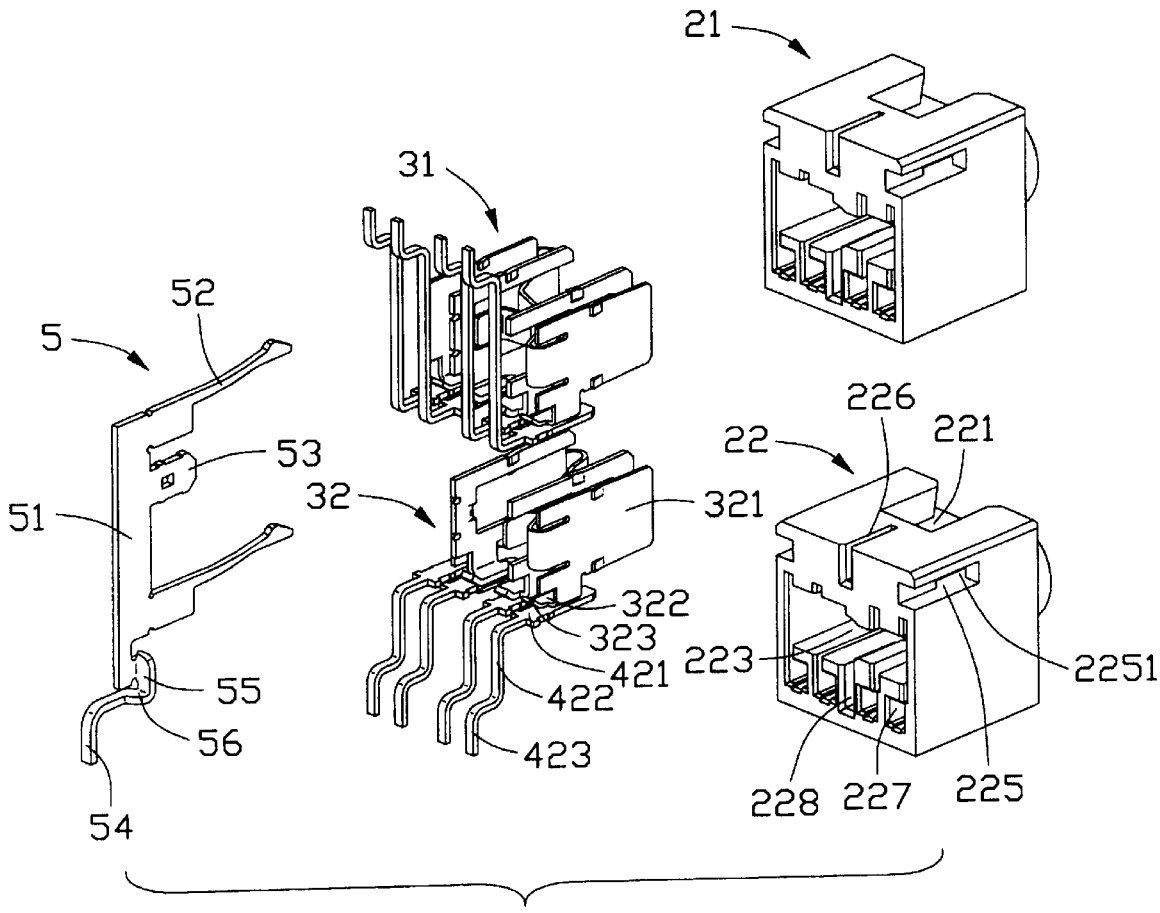
FIG. 2 is a view similar to FIG. 1, in an enlarged scale, from a rear aspect, and without showing a shield and a spacer of the connector assembly and the printed circuit board.

Further referring to FIG. 2, the first and second housing members 21, 22 have an identical structure, so only the second housing member 22 will be detailed hereinafter. The second housing member 22 has a cubical configuration and comprises a front cylindrical protrusion 222 which extends forwardly from a front face 229 thereof and defines a through hole 223 for receiving a plug connector (not shown) therein. A dovetail shaped recess 221 is defined in a top face of the second housing member 22 and through the front face 229. A dovetail shaped protrusion 224, corresponding to the dovetail shaped recess 221, extends downwardly from a bottom surface of the second housing member 22. A slit 226 is defined in a rear face of the second housing member 22 through the top face of the second housing 22. Four receiving slots 227 and a middle slot 228 are defined in a rear face of the housing 22 and extend forwardly toward the front face 229. Additionally, a pair of side slots 225 is defined in opposite sides of the second housing member 22 and a pair of recesses 2251 is defined inwardly at front ends of the side slots 225.

The two sets of first terminals 31 and 32 each comprise four longitudinal first conductive terminals 320. Each first conductive terminal 320 comprises a mating portion 321 and a contacting portion 322 extending perpendicularly from a bottom edge of the mating portion 321. Each contacting portion 322 has a tilting portion 323 at a rear end thereof. The two sets of second terminals 41, 42 have a similar structure and each have four terminals 420. Each terminal 420 has a contacting portion 421, a retaining portion 422 perpendicularly extending from the contacting portion 421, and a solder portion 423 extending from a free end of the retaining portion 422 and parallel to the retaining portion 422.

The one-piece grounding contact 5 comprises a vertical body strip 51 and two arms 52 horizontally extending forwardly from upper and lower ends of a front edge of the body strip 51. The arms 52 are spaced apart and parallel to each other. A latch 53 extends forwardly from the front edge of the body strip 51 and located between the arms 52. An angled portion 55 extends perpendicularly from a bottom end of the front edge of the body strip 51 below a lower one of the arms 52. A connection portion 56 extends rearward from a bottom end of the angled portion 55. A solder portion 54 extends perpendicular to the connection portion 56 and parallel to the angled portion.

Figure 3:
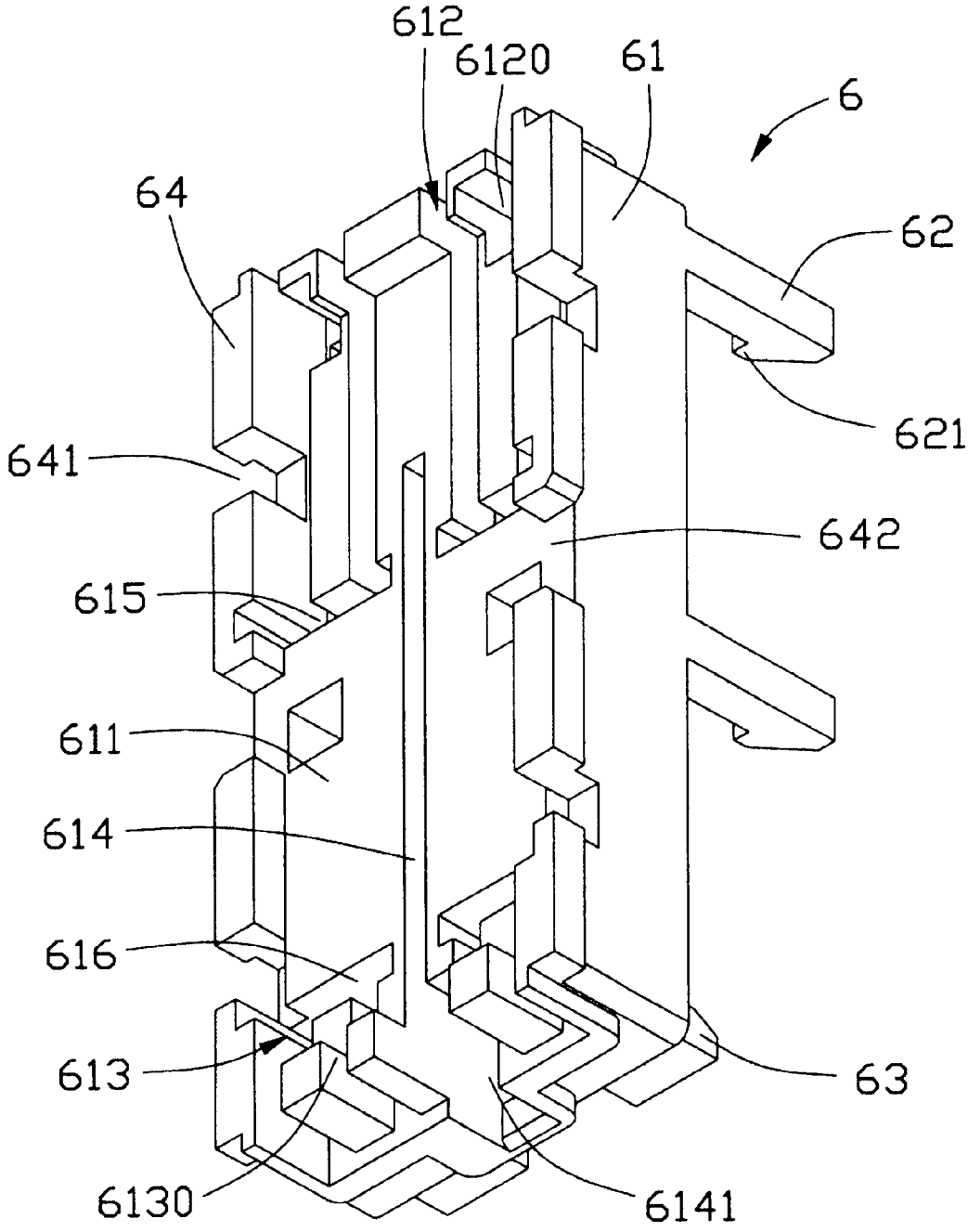
FIG. 3 is an enlarged perspective view of the spacer from a rear aspect.
Figure 4:
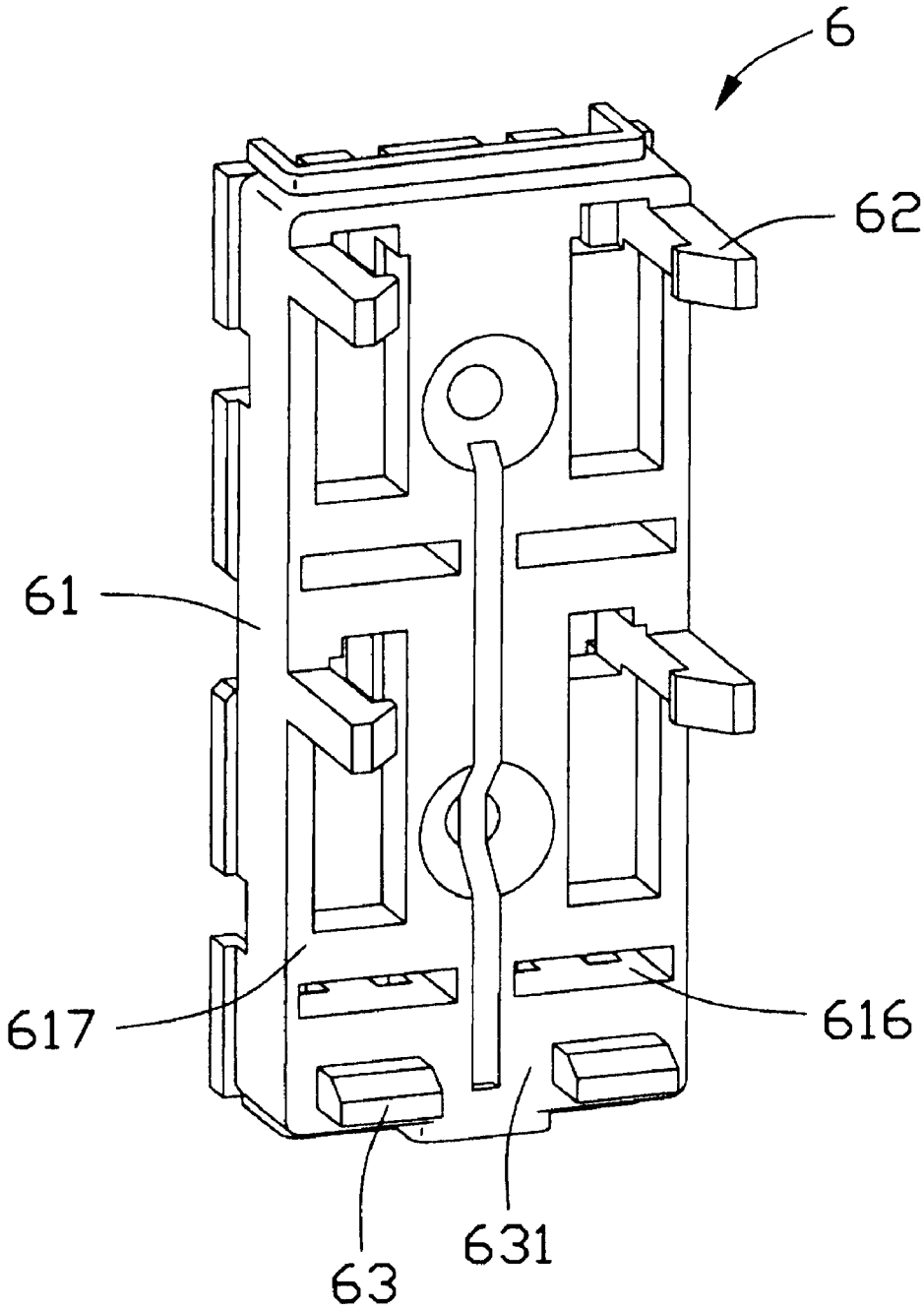
FIG. 4 is a view similar to FIG. 3, from a front aspect.

Referring to FIGS. 3 and 4, the spacer 6 has a base portion 61. The base portion 61 defines two similar upper and lower sets of retaining slots 612, 613 in a rear face 611 thereof, each set including two pairs of retaining slots 6120(6130). The retaining slots 6120 extend through an upper end of the base portion 61 and the lower retaining slots 6130 extend through a lower end of the base portion 61. Two pairs of insertion holes 615, 616 are defined through the base portion 61 from the rear face 611 to a front face 617 thereof and in communication with the two sets of retaining slots 612, 613, respectively. The base portion 61 further defines an elongated slit 614 in the rear face 611 from the lower end toward the upper end thereof. The elongated slit 614 runs through the base portion 61 from the rear face 611 to the front face 617 thereof. The elongated slit 614 has an enlarged part 6141 through the lower end of the base portion 61. The base portion 61 has two rows of standoffs 64 formed respectively on two opposite sides of the rear face 611. Each row of standoffs 64 defines an opening 642 in a middle part and two pocket 641 located respectively above and below the opening 642. Two pairs of hooks 62 extend forwardly from opposite sides of the front face 617 of the base portion 61. Each hook 62 has a barb 621 at a free end thereof. A pair of blocks 63 is formed on a bottom end of the front face 617 of the base portion 61.

Figure 5:
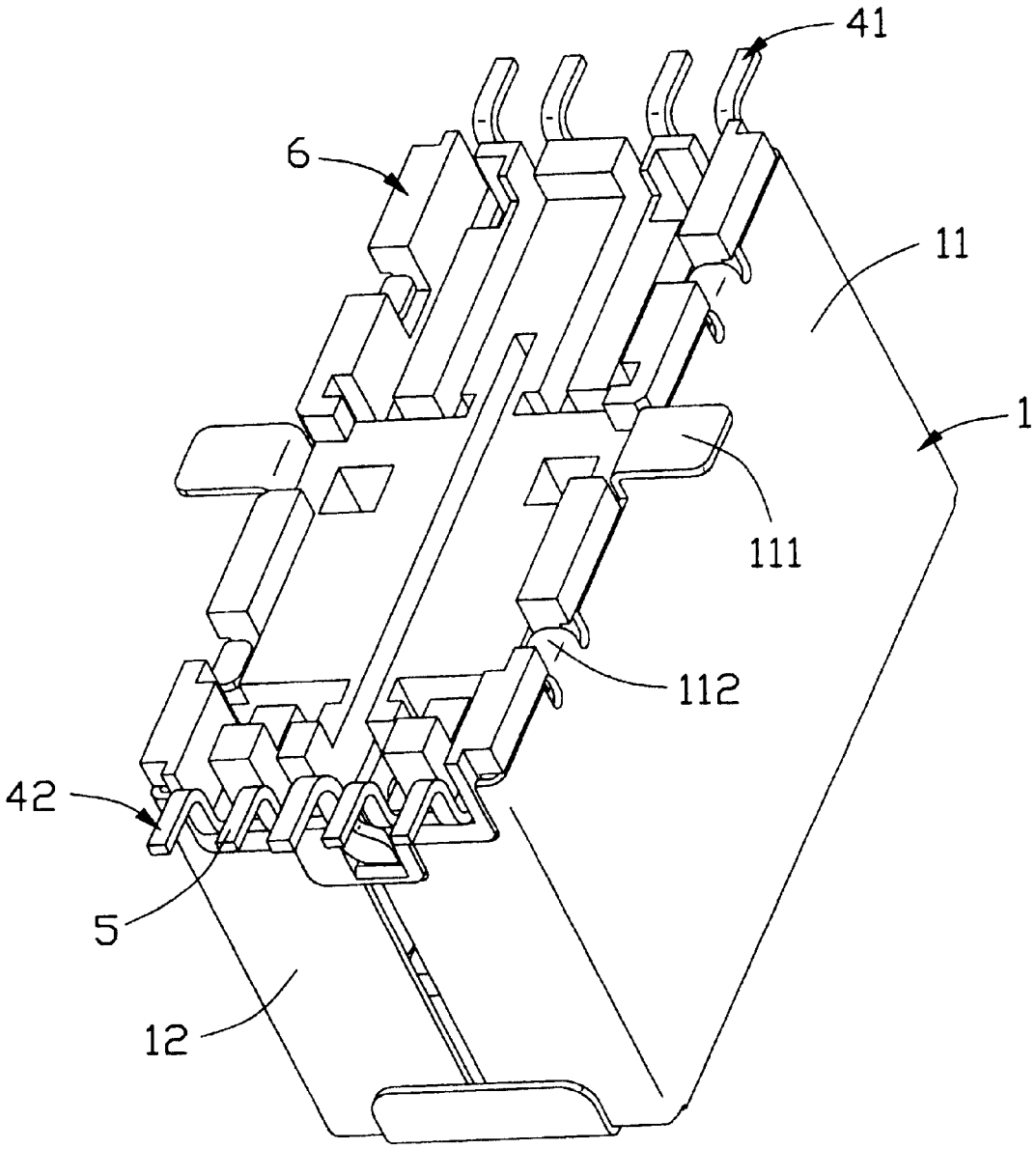
FIG. 5 is an assembled view of the electrical connector assembly of the present invention from a rear aspect.

Referring to FIGS. 1 and 5, the shield 1 has a cuboidal shape and comprises a pair of side walls 11, upper and bottom walls 12, and a front wall 13. The front wall 13 defines a pair of circular holes 131 corresponding to the front cylindrical protrusions 222 of the dielectric housing group 2. Each side wall 11 has a soldering wing 111 extending laterally outwardly therefrom and a pair of fastening tabs 112 formed respectively above and below the soldering wing 111. The fastening tabs 112 are used to be bent inwardly to engage in the pockets 641.

Figure 6:
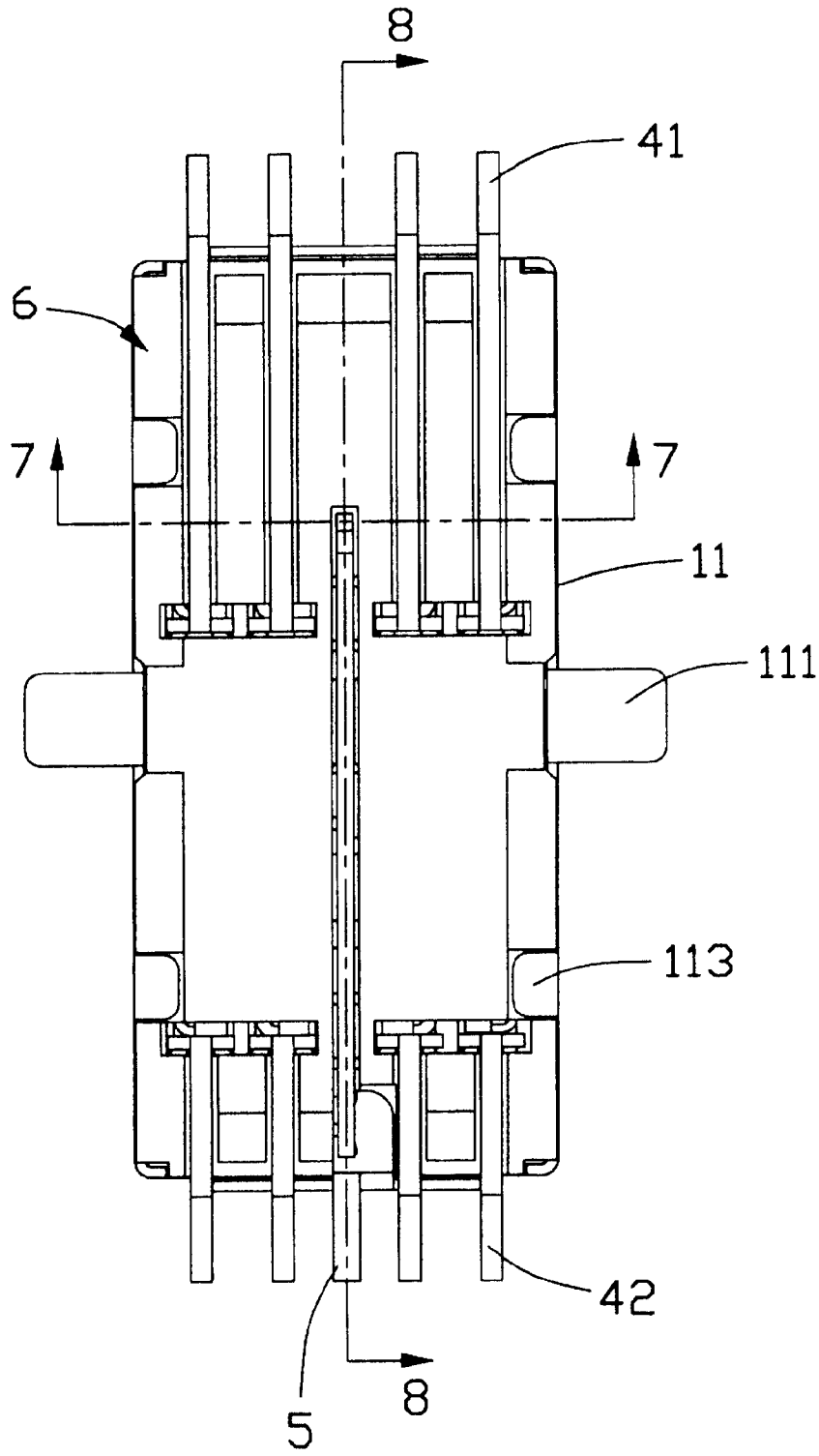
FIG. 6 is a rear plan view of the electrical connector assembly of FIG. 5.
Figure 7:
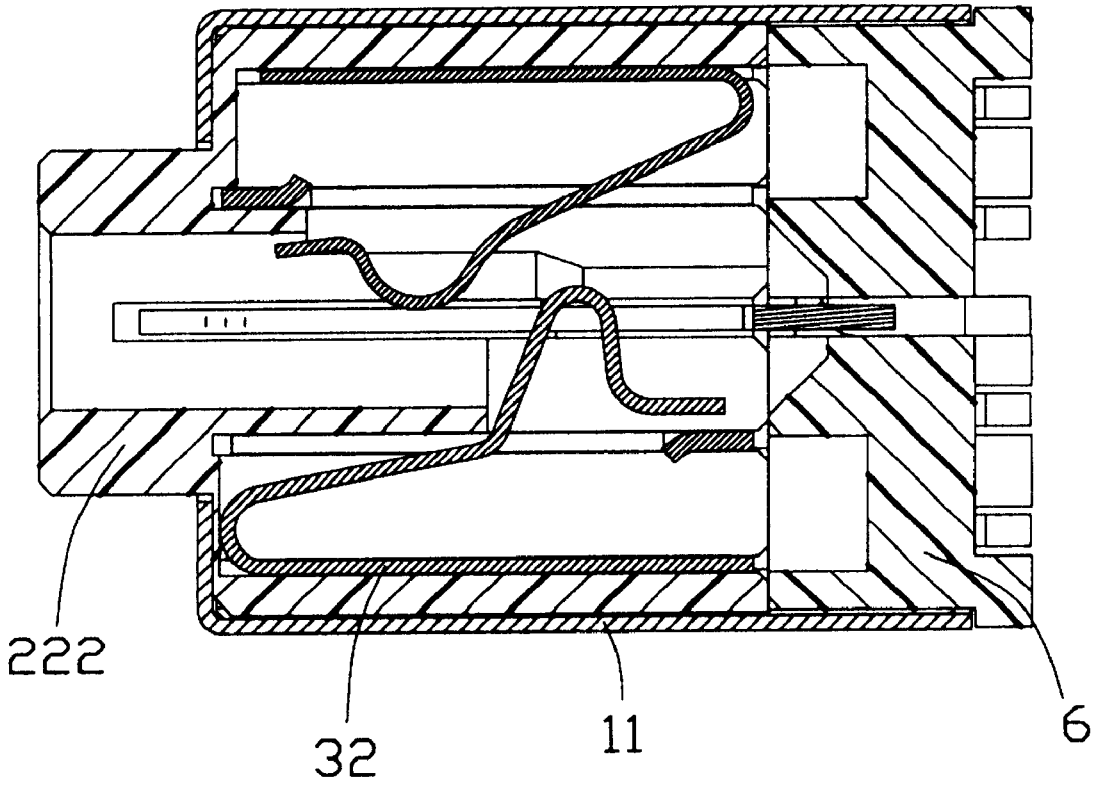
FIG. 7 is a cross-sectional view of the electrical connector assembly taken along line 7—7 of FIG. 5.
Figure 8:
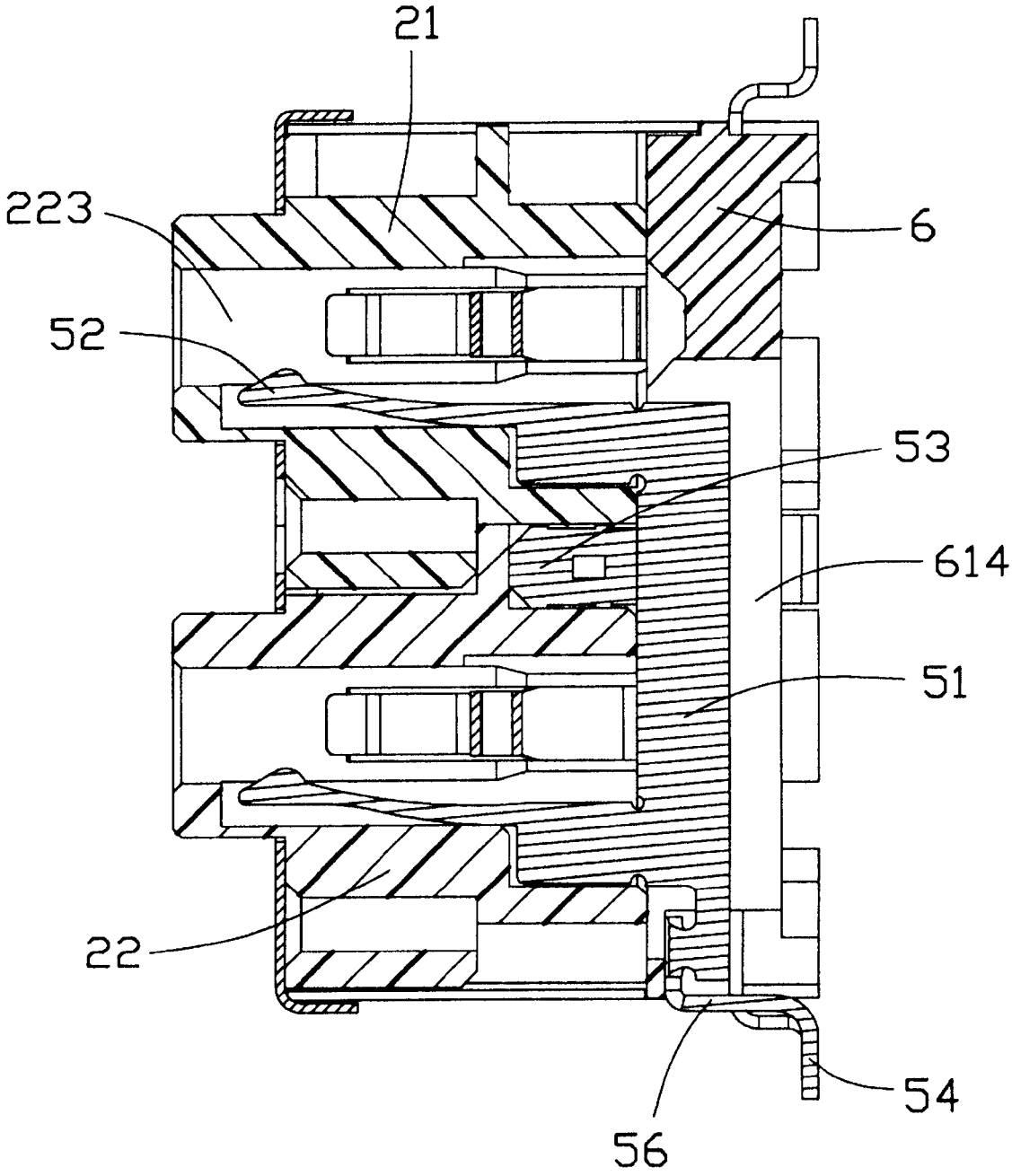
FIG. 8 is a cross-sectional view of the electrical connector assembly taken along line 8—8 FIG. 5.
Figure 9:
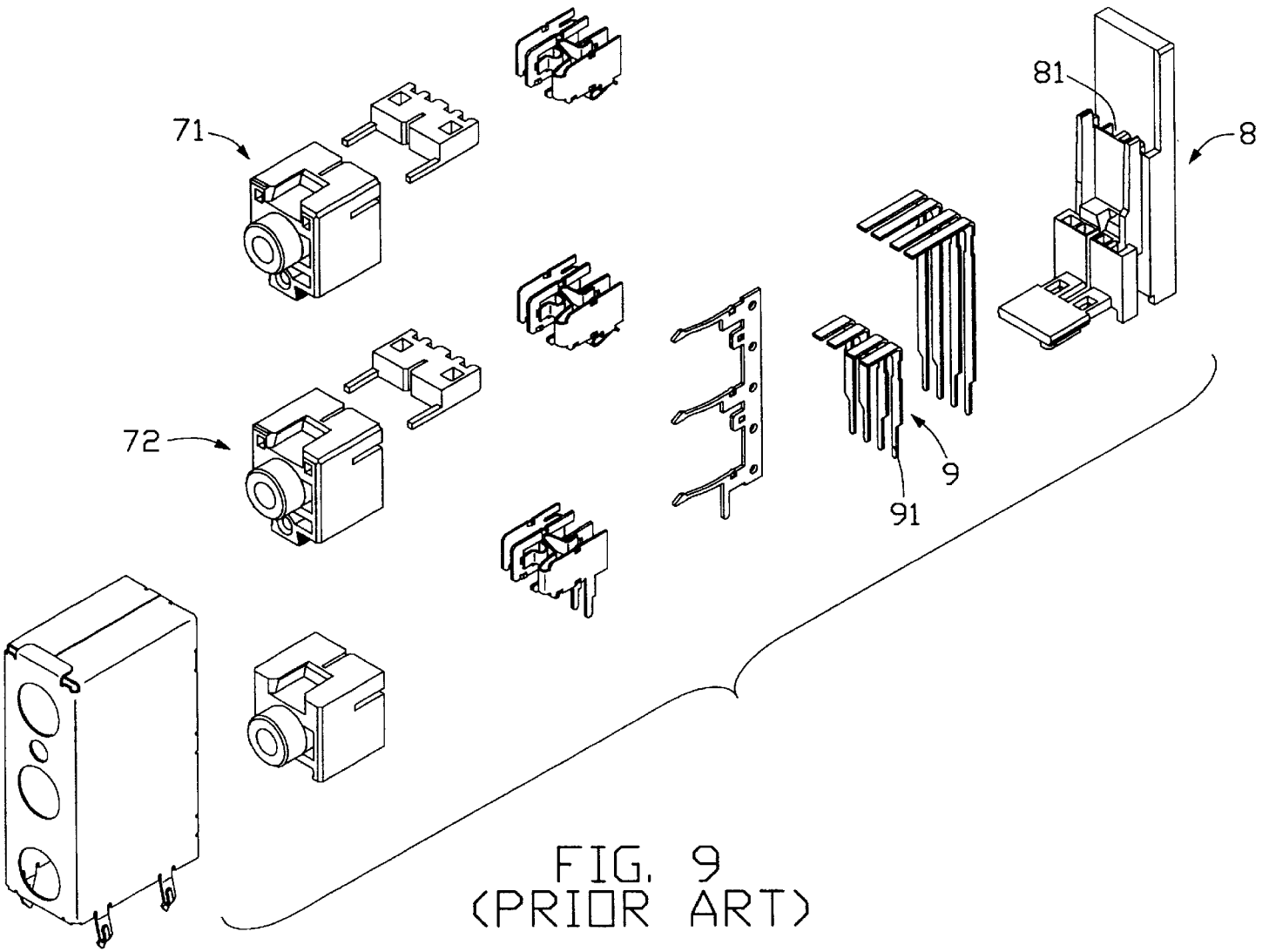
FIG. 9 (PRIOR ART)
FIG. 9 is an exploded perspective view of a conventional electrical connector assembly.

In assembly, further referring to FIGS. 6 through 8, the housing members 21, 22 are assembled together with the dovetail shaped protrusion 224 of the first housing member 21 engaged into the dovetail shaped recess 221 of the second housing member 22. The two sets of first terminals 31, 32 are inserted into the respective receiving slots 227 of the first and second housing members 21 and 22. The spacer 6 is assembled to the housing group 2 by the hooks 62 received in the side slots 225 of the first and second housing members 21 and 22, and the barbs 621 of the hooks 62 received in the recesses 2251, respectively. The dovetail shaped protrusion 224 of the second housing member 22 is received in a gap 631 defined between the two blocks 63, and a bottom face of the second housing member 22 is supported by the blocks 63. The two sets of second terminals 41, 42 are assembled in the housing group 2 and the spacer 6 by the contacting portions 421 inserted into the receiving slots 227 through the insertion holes 615, 616. Each contacting portion 421 is placed under and electrically connected with the contacting portion 322 of a corresponding first terminal 31(32). The retaining portions 422 of the second terminals 41, 42 are retained in the retaining slots 612, 613, and the solder portions 423 extend downwardly beyond the spacer 6. The vertical body strip 51 of the grounding contact 5 is received in the elongated slit 614 and the arms 52 are received in the middle slots 228 of the first and second housing members 21, 22 and extend into the through holes 223. The latch 53 is received in the slit 226 of the second housing member 22. The angled portion 55 and the connection portion 56 are received in the enlarged part 6141 of the slit 614. The shield 1 encloses the housing group 2 and spacer 6 with the two front cylindrical protrusions 222 extending through the circular holes 131. The solder wings 111 are positioned in the openings 642 and the fastening tabs 112 are received in the pockets 641 and then bent inwardly to engage with the rear face 611 of the spacer 6 to thereby securely fasten the shield 1, the housing group 2 and the spacer 6 together. The solder portions 423 of the second terminals 42, 43, the solder portions 54 of the grounding terminal 5 and the solder wings 111 of the shield 1 are soldered to solder pads 701 on the PCB 70. by surface mounting technology.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly adapted for mating with a mating connector and being mounted on a printed circuit board (PCB), comprising:

a dielectric housing having a front face adapted for mating with the mating connector and a rear face, the rear face defining a plurality of receiving slots extending toward the front face;

a plurality of first terminals, each first terminal comprising a first contacting portion received in a corresponding receiving slot of the housing;

a plurality of second terminals, each second terminal having a second contacting portion, a retaining portion extending from the second contacting portion, and a solder portion extending from the retaining portion and parallel to the rear face of the housing;

a spacer having a base portion with a plurality of retaining slots and insertion holes defined in a rear surface of the base portion, the insertion holes running through the base portion and in communication with the retaining slots of the spacer and the receiving slots of the housing, the retaining portions of the second terminals received in the retaining slots of the spacer, the second contacting portions of the second terminals inserted into the insertion holes and further received in the receiving slots of the housing to electrically connect with the first contacting portions of the first terminals; and a grounding terminal having a body strip received in one of the retaining slots of the spacer, an arm section extending from the body strip into one of the receiving slots of the housing and a solder portion extending from an end of the body strip, the solder portions of the grounding terminal and the second terminals extending downwardly beyond the spacer for being soldered to the PCB.

2. The electrical connector assembly as claimed in claim 1, the housing defines a pair of side slots in opposite sides thereof and a pair of recesses in a front end of the side slots, the spacer has a pair of hooks extending forwardly from opposite sides of a front face thereof, each hook has a barb at a free end thereof, the hooks are received in the side slots of the housing and the barbs are received in the recesses.

3. The electrical connector assembly as claimed in claim 1, the grounding terminal has an angled portion extending from a front edge of the body strip and perpendicular to the body strip, a connection portion extending from the angled portion and perpendicular to the angled portion, and the solder portion of the grounding terminal extends from a free end of the connection portion, said one of the receiving slots of the spacer receiving the grounding terminal having an enlarged lower part for receiving the angled portion and the connection portion.

4. An electrical connector assembly adapted for mating with mating connectors and being mounted on a printed circuit board (PCB), comprising:

a dielectric housing group including first and second housing members connected together and each housing member having a front face adapted for mating with a corresponding one of mating connectors and a rear face, a plurality of receiving slots defined in the rear face and extending toward the front face;

a plurality of first terminals, each first terminal comprising a first contacting portion received in a corresponding receiving slot of the housing members;

a plurality of second terminals, each second terminal having a second contacting portion, a retaining portion extending from the second contacting portion and a solder portion extending from the retaining portion;

a spacer having a base portion with a plurality of retaining slots and insertion holes defined in a rear surface of the base portion, the insertion holes running through the base portion and in communication with the retaining slots of the spacer and the receiving slots of the housing members, the retaining portions of the second terminals received in the retaining slots of the spacer, the second contact portions of the second terminals inserted into the insertion holes and further received in the receiving slots of the housing members and electrically connecting with the first contacting portions of the first terminals; and a grounding terminal having a body strip and a pair of arm sections extending from the body strip, each arm section assembled to one of the receiving slots of each housing member and the body strip received in one of the retaining slots of the spacer, a solder portion extending from an end of the body strip, the solder portions of the grounding terminal and the second terminals extending beyond the spacer for being soldered on the PCB.

5. The electrical connector assembly as claimed in claim 4, further comprising a shield enclosing the housing group and spacer.

6. The electrical connector assembly as claimed in claim 4, wherein the first and second housing members each define a pair of side slots in opposite sides thereof and a deeper recess in an end of each side slot, the spacer has two pairs of hooks extending from the front face thereof, each hook has a barb at a free end thereof, the hooks are received in the side slots of the first and second housing members, the barbs of the hooks are received in the recesses.

7. The electrical connector assembly as claimed in claim 4, wherein one of the retaining slots defined in the spacer has an enlarged lower part, the grounding terminal has an angled portion extending from a front edge the body strip and perpendicular to the body strip, a connection portion extending from the angled portion and perpendicular to the angled portion, the solder portion of the grounding terminal extends downwardly from a free end of the connection portion, the angled portion and the connection portion are received in the enlarged part of said one of the retaining slots.

8. The electrical connector assembly as claimed in claim 5, wherein the spacer has a pair of standoffs extending from the rear face of the base portion, each standoff defines an opening in a middle part and two pockets located respectively above and below the opening.

9. The electrical connector assembly as claimed in claim 8, wherein the shield comprises a pair of side walls, each side wall has a soldering wing extending laterally outwardly therefrom and a pair of fastening tabs formed respectively above and below the soldering wing and extending opposite to the soldering wing, the solder wing is placed at the opening and the fastening tabs are received in the pockets and engaged with the spacer.

10. The electrical connector assembly as claimed in claim 4, wherein the first and second housing members each define a slit in the rear face thereof, the grounding terminal has a latch extending from the body strip and received in one of the receiving slots.

11. The electrical connector assembly as claimed in claim 5, wherein the first and second housing members each have a dovetail shaped recess defined in a side thereof and a dovetail shaped protrusion formed in opposite side of the dovetail shaped recess, the dovetail shaped protrusion of the first housing member engages in the dovetail shaped recess of the second housing member.

12. The electrical connector assembly as claimed in claim 11, wherein the spacer has a pair of blocks formed on a lower end of the front face of the base portion, a gap is defined between the pair of the blocks, a dovetail shaped protrusion of the second housing member is received in the gap.

13. An electrical connector assembly adapted for mating with mating connectors and being mounted on a printed circuit board (PCB), comprising:

a dielectric housing group including first and second housing members connected together and each housing member having a front face adapted for mating with a corresponding of mating connectors and a rear face, a plurality of receiving slots defined in the rear face and extending toward the front face;

a plurality of terminals, each terminal comprising a mating portion, a retaining portion extending from the mating portion and a solder portion extending from the retaining portion; the mating portion being received in a corresponding receiving slot of the housing members, at least one mating portion of the terminals adapted for electrically connecting with the mating connector;

a spacer having a base portion with a plurality of retaining slots running through the base portion from a rear face to a front face and in communication with the receiving slots of the housing member, respectively;

a grounding terminal having a body strip and a pair of arm sections extending from the body strip, each arm section assembled to one of the receiving slots of the first and second housing members, respectively, a solder portion extending from the body strip, the body strip and the retaining portions of the terminals received in the retaining slots of the spacer, the solder portions of the grounding terminal and the terminals extending out of the spacer for being soldered on the PCB.

14. The electrical connector assembly as claimed in claim 13, wherein the first and second housing members define a pair of side slots in opposite sides thereof and a recess in an end of each side slot, the spacer has at least one pair of hooks extending form opposite sides of the front face thereof, each hook has a barb at a free end thereof, the hooks are received in the side slots of the first and second housing members, the barbs of the hooks are received in the recesses.

15. The electrical connector assembly as claimed in claim 14, wherein the grounding terminal has an angled portion extending from a front edge of the body strip and perpendicular to the body strip, a connection portion extending from the angled portion and perpendicular to the angled portion, the solder portion extending from the connection portion and parallel to the front face of the housing members, said one of the retaining slots receiving the grounding terminal has an enlarged lower part for receiving the angled portion and the connection portion.

16. An electrical connector assembly comprising:

a dielectric housing assembly including at least a pair of housing members side by side arranged with each other;

first and second substantially identical sets of first terminals respectively disposed in the housing members in a same orientation;

first and second substantially different sets of second terminals respectively in the housing members wherein first and second sets of second terminals mechanically and electrically engage with the corresponding first and second sets of first terminals around the same engagement positions of the first terminals, respectively, while have solder portions extending from around said same engagement positions toward opposite directions resulting in different configurations between the first and second sets of second terminals; wherein the first set of second terminals and the second set of second terminals include horizontal solder tails respectively extending outwardly on two opposite sides of the housing assembly.

17. The assembly as claimed in claim 16, wherein a grounding terminal transversely extends across both the pair of housing members with contact portions extending into the corresponding housing members for grounding respective complementary mating connectors.

18. The assembly as claimed in claim 17, wherein said grounding terminal only defines a horizontal solder tail on one side of the housing assembly.

* * * * *